United States Patent [19]

Karlsson

[11] 4,076,118

[45] Feb. 28, 1978

[54] DEVICE FOR LIMITING THE CONSUMPTION OF OBJECTS IN A CONTAINER

[76] Inventor: Jack Karlsson, Elvabovagen 30, 230 12 Hollviksnas, Sweden

[21] Appl. No.: 802,556

[22] Filed: Jun. 1, 1977

[30] Foreign Application Priority Data

Jun. 14, 1976 Sweden ..... 7606719

[51] Int. Cl.[2] ..... B65D 85/10

[52] U.S. Cl. ..... 206/268; 70/269; 70/272; 131/171 A; 206/1.5; 206/247

[58] Field of Search ..... 131/171 A; 206/1.5, 206/265, 236, 38, 242, 247, 259, 268; 215/206, 224, 225; 70/267, 268, 269, 270, 272, 273, 274, 312

[56] References Cited

U.S. PATENT DOCUMENTS

| | | | |
|---|---|---|---|
| 2,039,019 | 4/1936 | Miller et al. | 70/269 |
| 2,191,614 | 2/1940 | Frantz | 220/206 |
| 2,618,956 | 11/1952 | Hanna | 131/242 |
| 2,658,468 | 11/1953 | Enfield | 70/273 |
| 2,675,693 | 4/1954 | Emery | 206/256 |
| 2,960,046 | 11/1960 | Clark | 70/267 |
| 3,206,957 | 9/1965 | Reitzes | 206/265 |
| 3,363,439 | 1/1968 | Kende | 70/272 |
| 3,798,937 | 3/1974 | Sysk | 70/269 |
| 3,999,412 | 12/1976 | Boroski et al. | 70/269 |
| 4,037,719 | 7/1977 | Perlmutter | 206/236 |

*Primary Examiner*—William Price
*Assistant Examiner*—Bruce H. Bernstein
*Attorney, Agent, or Firm*—Laurence R. Brown

[57] ABSTRACT

A timer is attached to a cigarette container to permit opening only after a preset time by mounting on the container wall with a rotary timing member presenting after the elapsed time a notch to release a container locking member for opening the container.

3 Claims, 2 Drawing Figures

DEVICE FOR LIMITING THE CONSUMPTION OF OBJECTS IN A CONTAINER

Many persons have a desire to limit their consumption of a certain product or article. The most typical example is the desire to limit the consumption of cigarettes, cigars, or the like. It is a known fact that a person may pick up a cigarette from its packet, light it and consume it without being conscious of it; the smoking has in such a case been reduced to a mechanical handling.

Several devices for limiting the consumption of objects, particularily but not exclusively cigarettes or the like, in a container or package are known. The container is provided with a timer and locking means arranged only to permit opening of a releasable container cover after the timer has run a predetermined time.

A person with a desire to cut down his cigarette consumption may thus gradually increase this predetermined time from say a quarter of an hour to 2 hours and the device will prevent him from taking a cigarette from the container when the timer has not run the predetermined time and when the locking means thus hold the container closed.

In order to ensure a maximum usage of such a device, good for the health, it is essential on the one hand to keep the dimension to a minimum, on the other hand to keep the design as simple, cheap and reliable as possible.

This is according to the invention attained by a device which is characterized in that the timer is attached to a container wall and has its outwardly extending turning shaft perpendicular to said wall, the shaft being provided with an attached locking cap, which is coaxial therewith and, when the cover is closed, covers a locking head arranged at the opening edge of the cover, the locking cap being provided with a notch, which in a certain turning position corresponding to the inital position for the timer attains a position at the locking head for releasing the same.

By turning the locking cap a certain angle from its initial position with the notch at the locking head the latter and thus the container cover will be locked and the timer will be wound and will run until the notch again comes to its position at the locking head, making it possible to open the container cover and to bring out an object (cigarette) therefrom.

As commercially available timers usually can be brought back to their initial positions with force exerted on their turning shafts, which is undesirable for the smoker whose cigarette consumption is to be limited, certain measures must be taken to prevent such forced turning back of the timer.

This is according to the invention attained in that a preferred embodiment is characterized by a cup shaped protecting cap rotatably arranged coaxially outside the locking cap and having a notch for the locking head, the locking cap being provided with an external driver and the protecting cap being provided with an internal driver, which drivers are arranged to cooperate to enable the timer to be wound by means of the protecting cap.

Figure 2:
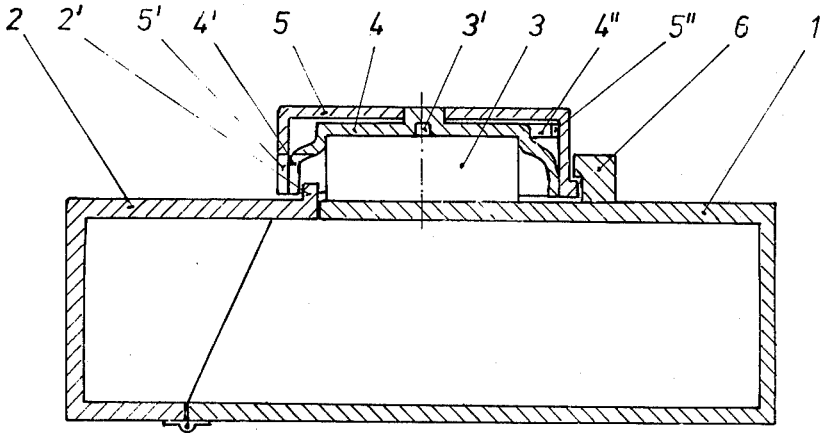
Figure 1:
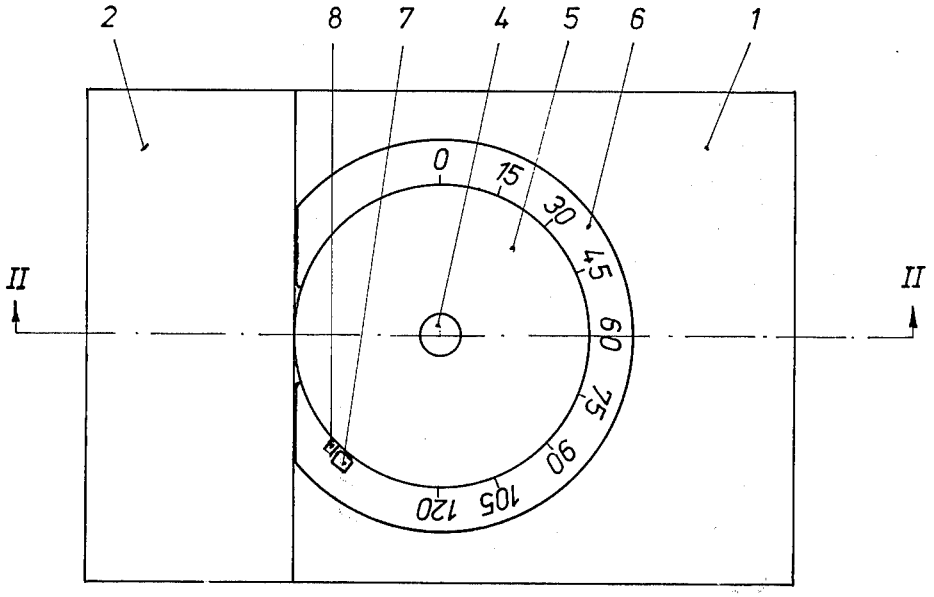

A preferred embodiment of the invention is to be described in further detail below, reference being made to the accompanying drawing, in which FIG. 1 is a top view of a cigarette case with a device according to the invention, and FIG. 2 is a section along the line II—II in FIG. 1.

A container or case 1, which is dimensioned to contain an ordinary cigarette packet, is provided with a pivotally attached cover 2. On the container is mounted a mechanical timer 3, which for example will run two hours after a rotation of 180° of its turning shaft 3'. This timer may or may not give a signal after having run out.

A cup-shaped locking cap 4 is fixedly mounted on the timer shaft 3' and is provided with a notch 4' for a locking head 2' on the cover 2. In the shown initial position it will be possible to pivot the cover 2 to an open position, as the notch 4' is situated at the locking head 2', but this is impossible in all other positions of the locking cap 4, which then will cover the locking head 2'.

The so far described arrangement is sufficient for the purpose of the invention, if it is not possible to return the locking cap 4 and thus the timer 3 to the initial position manually. However, in most cases this will be possible, and therefore a cup-shaped protecting cap 5 is rotatably arranged coaxially over the locking cap 4 without any connection with the timer shaft 3' and is likewise provided with a notch 5' for the locking head 2'. Both the notches 4' and 5' must be in the shown positions to permit opening of the cover 2.

The protecting cap 5 is provided with an internal driver 5'' and the locking cap 4 with an external driver 4'' so cooperating with the former driver 5'' that upon clockwise turning (FIG. 1) of the protecting cap 5 also the locking cap 4 will be turned clockwise and the timer 3 wound.

To prevent any intrusion in the device there is a protective ring 6 on the container 1 around the protecting cap 5 except for the area at the locking head 2'. As shown in FIG. 1 this ring may be provided with time markings. The ring 6 may also be provided with an embossment 7 and the protecting cap 5 with a projection 8 as shown in FIG. 1, so that the protecting cap 5 cannot be turned more than about 360°.

It has to be noted that many modifications are possible within the scope of the appended claims. Thus, the cover need not be pivotally attached to the container but may, in order to further reduce the costs, be threaded thereon and kept in position by the locking means. It may further be noted that it could be possible to operate the timer at the upwardly extending pin of the locking cap 4, the pin being the rotational axis for the protecting cap 5, and that in order to avoid this operation a "cover" may be provided over this pin in a modification. Further, an extension or edge may be arranged on the cover 2 in the vicinity of the notches 4' and 5' in order to prevent intrusion that way.

I claim:

1. A container assembly including a timed lock apparatus, comprising in combination, a container having a openable cover, a presettable manually wound timer mounted on a wall of said container of the type that is wound by rotation of a shaft in one direction and which rotates in the opposite direction to a limit position for a time period which is a function of the degree of shaft rotation in the winding direction having a rotatable member operated by a timing mechanism thereof with a notch in said member movable to a registry position at said limit position after a time preset on said timer, a locking member movable with said cover into said registry position when the cover is closed and retained by said rotatable member to lock the cover closed except when said notch is presented in said registry position, and a protecting cap which control said timings mechanism by rotating said shaft only in said wound direction to set a further time period thereon, whereby the reduction of a preset time by manual access to said shaft is prevented by said protecting cap.

2. An assembly as defined in claim 1 wherein said rotatable member comprises a cup shaped part rotatable with a timing shaft manually turnable in one direction to set and in another direction to reduce the preset time and said protective means comprises an outer cap encompassing said cup shaped part with means engaging the rotatable member only in the setting direction.

3. An assembly as defined in claim 1 wherein said container is rectangularly dimensioned to contain a cigarette packet, said cover comprises a pivotable top member hinged at one container face and with the locking member positioned on an opposite container face, wherein said timer is affixed to said opposite face.

* * * * *